US006058983A

United States Patent [19]

Bourgeaux et al.

[11] Patent Number: 6,058,983

[45] Date of Patent: May 9, 2000

[54] JACQUARD-TYPE WEAVING MECHANISM AND LOOM EQUIPPED WITH SUCH A WEAVING MECHANISM

[75] Inventors: Pierre Bourgeaux, Poisy; Jean-Paul Froment, Doussard, both of France

[73] Assignee: Staubli Faverges, Faverges, France

[21] Appl. No.: 09/218,301

[22] Filed: Dec. 22, 1998

[30] Foreign Application Priority Data

Dec. 24, 1997 [FR] France ..... 97 16737

[51] Int. Cl.[7] ..... D03C 3/20

[52] U.S. Cl. ..... 139/455; 139/59

[58] Field of Search ..... 139/455, 66 R, 139/59, 383 AA, 62, 456, 319

[56] References Cited

U.S. PATENT DOCUMENTS

| | | | |
|---|---|---|---|
| 4,440,196 | 4/1984 | Arvai . | |
| 5,125,435 | 6/1992 | Froment | 139/455 |
| 5,309,953 | 5/1994 | Bassi et al. . | |
| 5,462,097 | 10/1995 | Skalka . | |
| 5,819,813 | 10/1998 | Dewispelaere | 139/455 |

FOREIGN PATENT DOCUMENTS

| | | |
|---|---|---|
| 0304985 | 3/1989 | European Pat. Off. . |
| 2680526 | 2/1993 | European Pat. Off. . |
| 0577524 | 1/1994 | European Pat. Off. . |
| 0668381 | 8/1995 | European Pat. Off. . |
| WO8102312 | 8/1981 | WIPO . |
| WO8701142 | 2/1987 | WIPO . |
| WO9409197 | 4/1994 | WIPO . |
| WO9506767 | 3/1995 | WIPO . |

*Primary Examiner*—Andy Falik
*Attorney, Agent, or Firm*—Dowell & Dowell, P.C.

[57] ABSTRACT

Housings to enclose winding actuators for the vertical control of harness threads of a weaving mechanism are arranged in rows and/or columns to form at least one panel positioned in the upper portion of a weaving loom.

15 Claims, 6 Drawing Sheets

JACQUARD-TYPE WEAVING MECHANISM AND LOOM EQUIPPED WITH SUCH A WEAVING MECHANISM

BACKGROUND OF THE INVENTION

1. Field of the Invention

The present invention relates to the mechanisms used in looms used for the formation of the shed and, especially, to the Jacquard-type weaving mechanisms. The invention relates also to a weaving loom equipped with such a mechanism.

2. Description of the Related Art

It is known that the standard construction of the Jacquard mechanisms comprises a control mechanism or head installed on top of the loom, and a harness connecting this head to the warp threads in tension on this loom. This harness itself comprises a number of harness threads that are directly and individually controlled in a vertical direction by the head; each of these harness threads is gathered by a collar to one or several heddles, being each of these heddles provided with an eyelet through which passes a warp thread.

Patent EP-A-214 075 shows the manner in which to constitute modules comprising electromagnets and selector elements. These modules can be rearranged on top of the loom on an essentially horizontal strip. In the case of a large number of selector elements, this strip is of considerable size on a horizontal plane. The operation of the electromagnets, of the selection elements and of the driving system determines the positioning of these modules.

Patent applications FR-97 16734 and FR-97 16738 describe a rotary winding actuator intended to replace the knives and lifting blocks actuator mechanisms of the standard constructions, being each of these actuators constituted by a rotary electric motor on the shaft of which is mounted a pulley or a drum for the winding up and the unwinding of a harness thread.

In patent application FR-97 16735 it was submitted to mount the rotary actuators of above-mentioned type inside of an essentially parallelepipedal housing that is divided by internal partitions into a series of compartments aligned according to regular horizontal and vertical rows. Each of these compartments is fit to receive at least one actuator while it is provided with control means appropriate to prevent that the harness threads coming from the actuators of a same row do not interfere with each other.

SUMMARY OF THE INVENTION

The object of the present invention is the assembly of a number of housings of above-mentioned type with the idea of obtaining a Jacquard-type weaving mechanism comprising a multitude of individual actuators accommodated inside of said housings; the purpose of this assembly is to present the harness threads coming from the various housings interfere with each other, allowing the obtaining of an assembly of reduced space requirement that offers easy access to the individual actuators for their maintenance. Another aim of the invention is to provide a weaving mechanism of such a design that the run of harness threads between the actuator and the corresponding heddle(s) is the most direct in order to reduce the friction load, the angles of deflection and the length of the harness threads.

With this in mind, the present invention relates to a Jacquard-type weaving mechanism for the formation of the shed on a loom, characterized by the fact that the harness threads attached to the heddles associated to the warp threads are controlled by electric actuators mounted on a control panel in the compartments of a multitude of housings, which housings arc arranged according to rows and columns, and which rows and/or columns of housings form at last one panel positioned at the top of the loom.

Thanks to the invention, the thus formed panels enable to attain the above-mentioned enumerated objectives. These panels can be vertically positioned or tilted at an angle of up to 60° with respect to the vertical above the warp threads, thus reducing the depth space required, that is to say, parallel to the warp threads. The height of the panels, that is to say the number of rows of housings, can be used to adapt the number of actuators to the number of the required individual controls.

According to advantageous aspects, the present invention does also incorporate the following features.

On each panel, the rows of housings present, from the bottom up, an outward turned horizontal staggering between them. This staggering can be standard on each of the panels and presents a rectilinear profile. Further, on each panel this staggering can regularly increase from the bottom up, so that it confers it an arc-shaped profile.

The housings of a same row or same column are affixed inside of concave structural elements that are mounted to each other.

The assembling of the structural elements is effectuated with the aid of means lodged in holes cut in the sides of the structural elements, being the distance that separates a bottom wall of each structural element from the hole cut into the upper flange is a greater than the distance between the bottom wall and the hole cut in the bottom flange.

The housings of some rows of each panel are provided with guides through which pass the harness threads coming from the actuators of the upper rows.

The housings are attached to the structural elements providing a clearance for the circulation of a cooling agent.

This space is separated from the actuators and their control elements by an internal rib of each structural element.

At least some of the panels are jointed and coupled to a control mechanism.

The structural elements are appropriate for the mounting of the housings on both sides of a vertical plane.

The invention does also relate to a weaving loom equipped with a weaving mechanism as described above. Such a loom is easier to use and to maintain than the looms of known type.

Its efficiency is considerably improved with respect to the known technique and it allows to control thread by thread of a Jacquard harness.

BRIEF DESCRIPTION OF THE DRAWINGS

The invention can be better understood, its characteristics and the advantages it can offer can be seen better with the help of the accompanying illustrations, given by way of example.

DESCRIPTION FO THE PREFERRED EMBODIMENT

Figure 1:
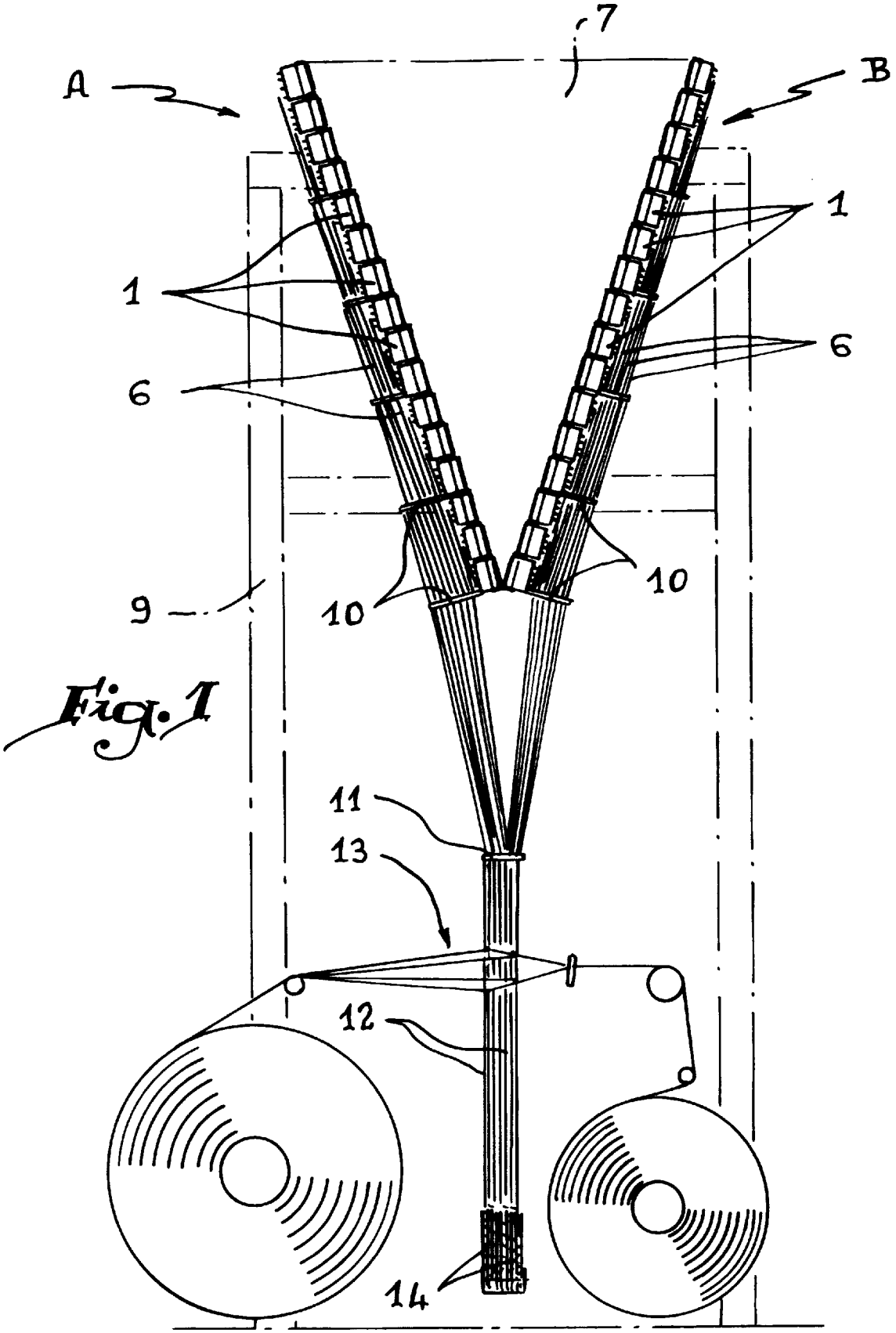
FIG. 1 shows a front view, illustrating in a very diagrammatical manner the design of a weaving mechanism, including two panels according to the invention.

The mechanism, schematically represented in FIG. 1, is formed by the mounting of a multitude of housings 1, each of which is provided on the inside with several rotary actuators arranged in each of these housings according to regular vertical and horizontal alignments. In order to clarify the idea on hand of a definite example, it must be surmised that the internal partitions of each housing 1 define sixteen compartments, arranged according to four superimposed horizontal rows each of four compartments.

Figure 2:
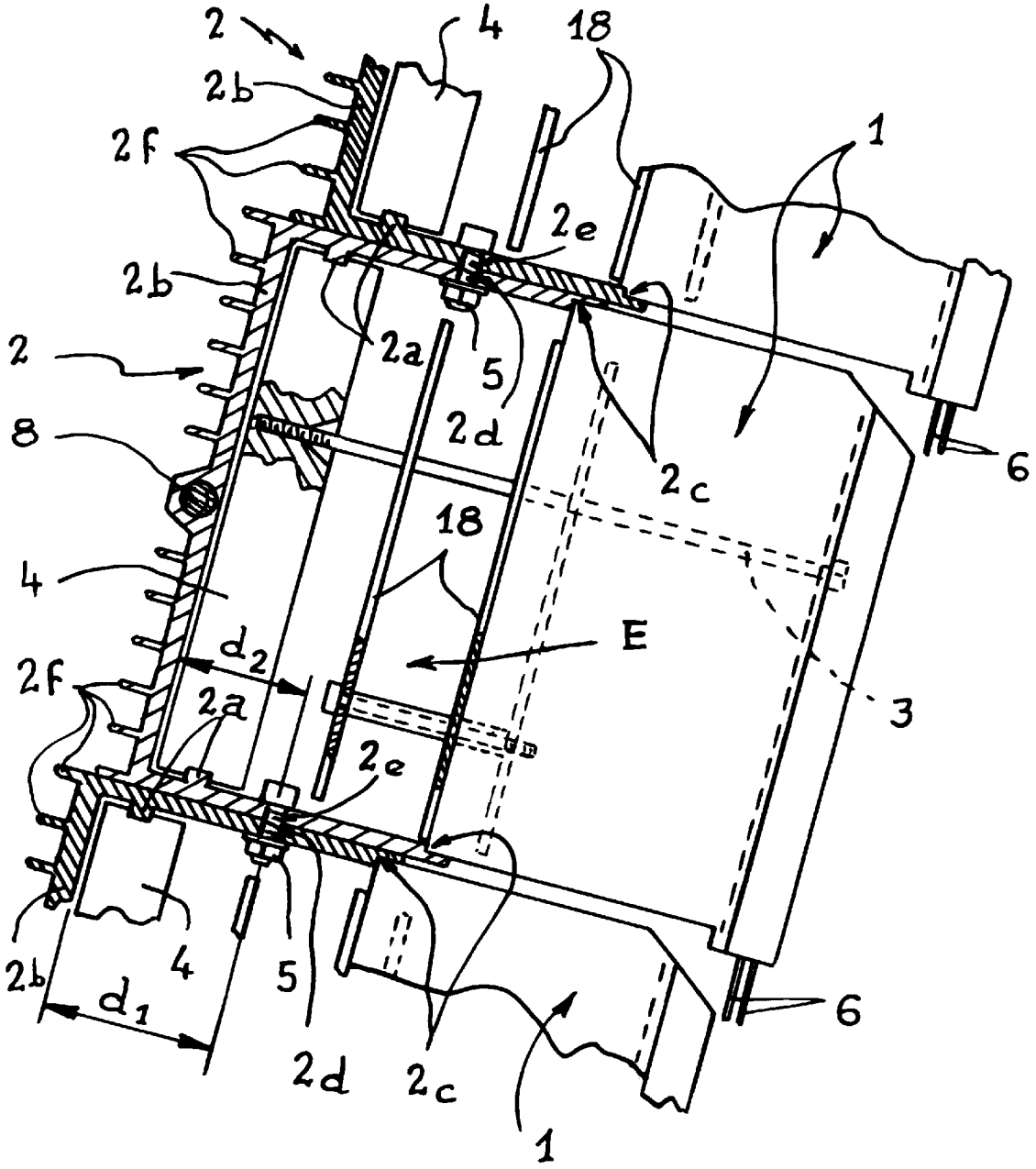
FIG. 2 shows a vertical section, illustrating in an enlarged scale the vertical assembly of the housings of three superimposed horizontal rows.

As illustrated in FIG. 2, the rear part of each housing 1 is mounted inside of the lateral opening of a structural element 2 presenting a C-section, thus concave, that extends horizontally over the entire length of the mechanism in order to ensure the mounting of a certain number of housings 1 on the same horizontal row. The attaching of each housing 1 to the structural element 2 is effectuated by means of threaded rods 3 that pass through the housing in question to be screwed into a tap provided on a back crosspiece or bar 4, of which the upper and lower edges are slotted in order to interact with the ribs 2*a* provided on the sides of the structural element 2, directly ahead of its bottom deformation or bottom wall 2*b*. The clamping of these rods 3 ensures the application of force of the bottom of each housing 1 against a flange 2*c* recessed on each side of the structural element 2 in question.

The structural elements 2 are vertically affixed to each other by means of bolts 5 lodged in holes bored in the sides of the structural elements. It must be noted that the holes bored in the two sides are offset with respect to each other: the distance $d_1$ between the hole 2*d* on the upper side and the bottom deformation 2*b* of the structural element is greater than the distance $d_2$ that separates the lower hole 2*e* from this bottom deformation.

Under these conditions, the assembly of the structural elements 2 by means of the bolts 5 ensures a horizontal displacement of the structural elements, whereby the front of each structural element 2 laterally projects beyond the front of the structural element 2 that is immediately arranged below it. Thus, the harness threads 6 coming from the actuators located in the same vertical column of the compartments of a same housing 1 are offset with respect to those coming from the same vertical column of actuators of the housings 1 located below and above of the housing in question.

In the case illustrated in FIG. 2, the distances $d_1$ and $d_2$ are respectively identical for all the structural elements 2. These latter are distributed according to two distinct series, so that the assembly of the housings 1 on the structural elements 2 define two rigid and rectilinear panels A and B (FIG. 1) oriented obliquely defining a V-shaped assembly.

On each panel A and B, the structural elements 2 of each horizontal row are mounted to each other by means of horizontal rods 8 (FIG. 2) of which the ends are affixed to two lateral, triangle-shaped flanges 7 (FIG. 1). These flanges 7 are held by a vertical frame 9 that rises above the loom provided with the mechanism.

In view of the rectilinear profile of each of the two panels A and B, in practice it is necessary that the housings 1 of some of the horizontal rows (one out of three in the example shown in FIG. 1) be provided with guides 10 through which pass the harness threads 6 coming from the actuators contained in the housings. Underneath the panels A and B, these harness threads 6 are gathered together by a harness tie 11 before being fed to the vertical heddles 12 that pass through the warp of the warp threads 13 and that are attached to the lower return springs 14.

The number of panels A and B, constituting the mechanism, may vary to a great extent, depending in particular on the number of housings 1 to be mounted.

Figure 3:
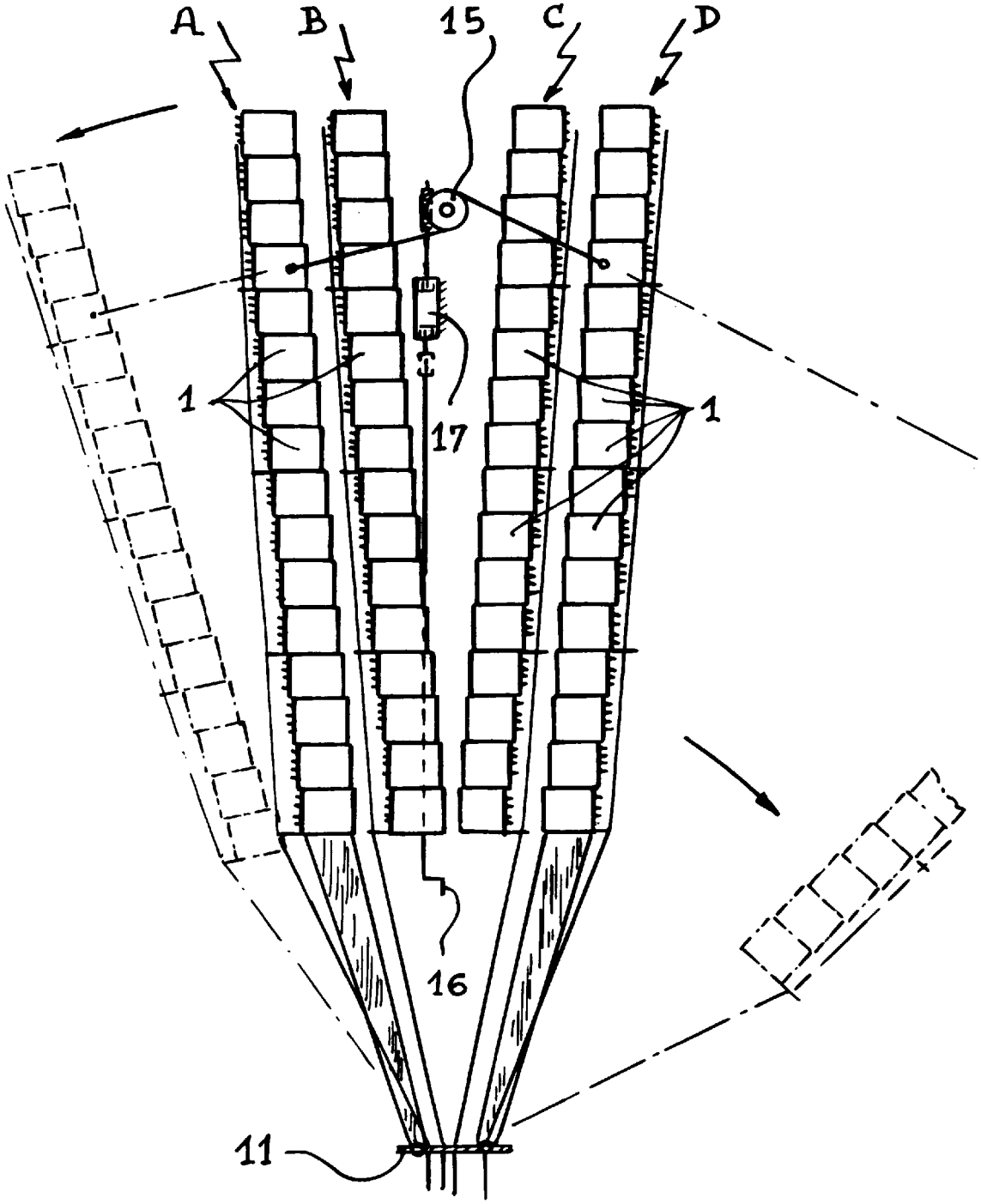
FIG. 3 shows in the same manner as FIG. 1, a variant of the invention.

FIG. 3 illustrates a variant of the design of the present invention in which the mechanism is provided with four rigid panels A, B, C, and D, vertically oriented above the harness tie 11. In order to allow access to the housings 1 from the inside panels B and C, the outside panels A and D are articulated at the base at the tie 11 and they interact with a control mechanism such as a double handling winch 15, that is operated by means of a spindle stick 16 and/or a motor 17, through a hollow wheel and irreversible endless screw system.

In the embodiment illustrated in FIG. 3, the outside panels A and D swivel around an area located in the proximity of the harness tie 11. It is possible to have these panels swivel around zones located above or below this tie and more or less at the path of the harness threads. The design can also be such, that the panels A and B swivel around a horizontal axis located at mid-height of each of them.

Figure 4:
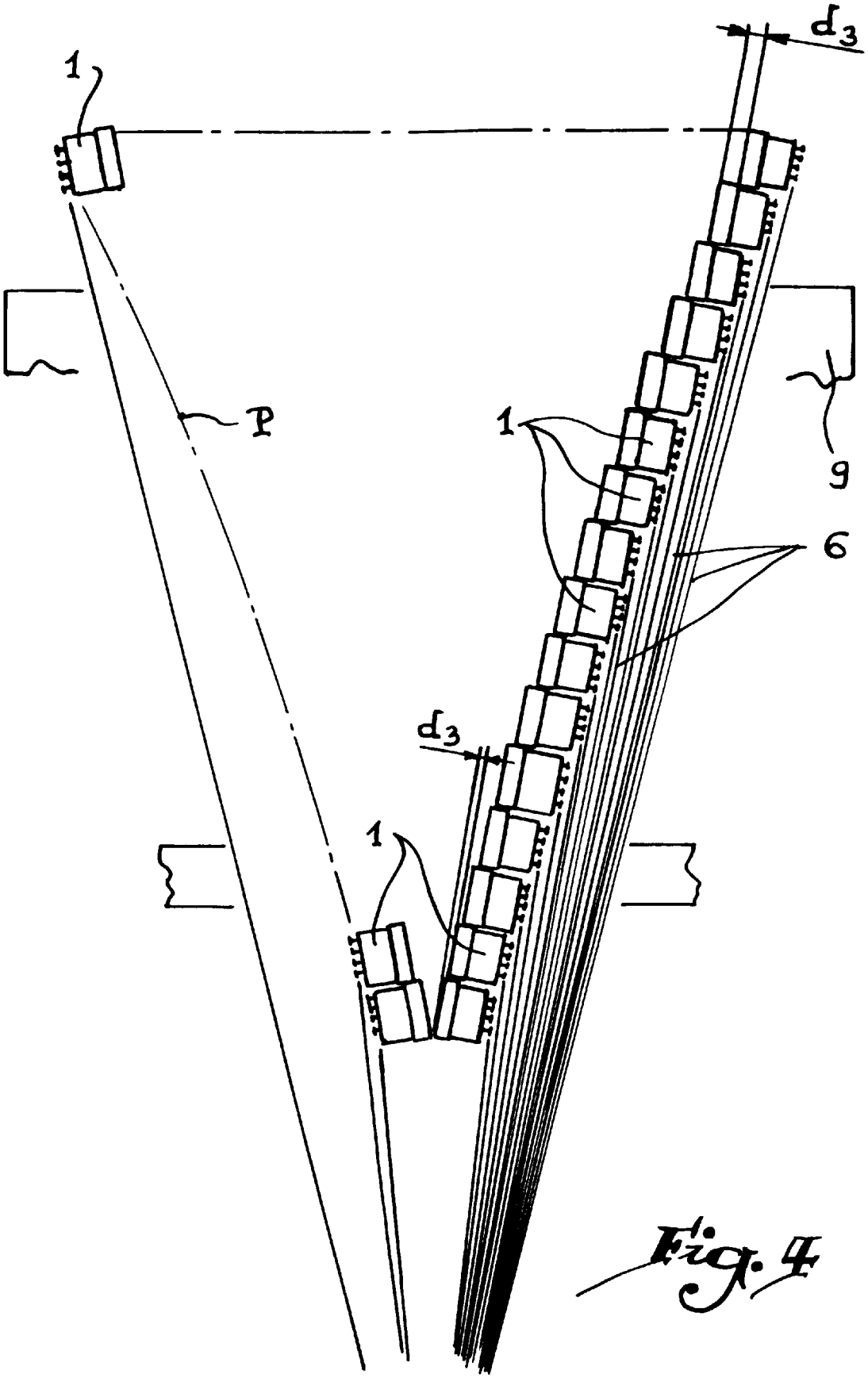
FIG. 4 shows a second variant of the invention.

In the embodiment illustrated in FIG. 4, the lateral offset $d_3$ provided between the horizontal rows of the structural elements 2 is variable in the sense that, in each panel A and B, it increases very slightly from the bottom upwards. Under these conditions, each of these panels does not longer present the rectilinear profile shown in FIG. 1 but a generally curved profile P, represented by a dot-and-dash line in FIG. 4. This profile eliminates any risk of interference between the harness threads 6 of the superimposed rows. Thus, one can dispense with the above-mentioned guides 10.

Furthermore, in FIG. 2 it can be noted that the flanges 2*c* on the sides of each structural element 2 are positioned in such a manner that the bottom of each housing 2 is positioned at a relatively great distance from the base or the bottom wall 2*b* of said structural element 2. The thus obtained space E allows the housing of the printed-circuit boards 18 (FIG. 2) for the power supply of each housing. This space can be connected to a ventilation installation for the circulation of an air current for the dissipation of the heat generated by the electronic components and the actuators; it is noted that the exterior side of the bottom wall 2*b* of each structural element 2 is advantageously provided with cooling fins 2*f*.

Figure 5:
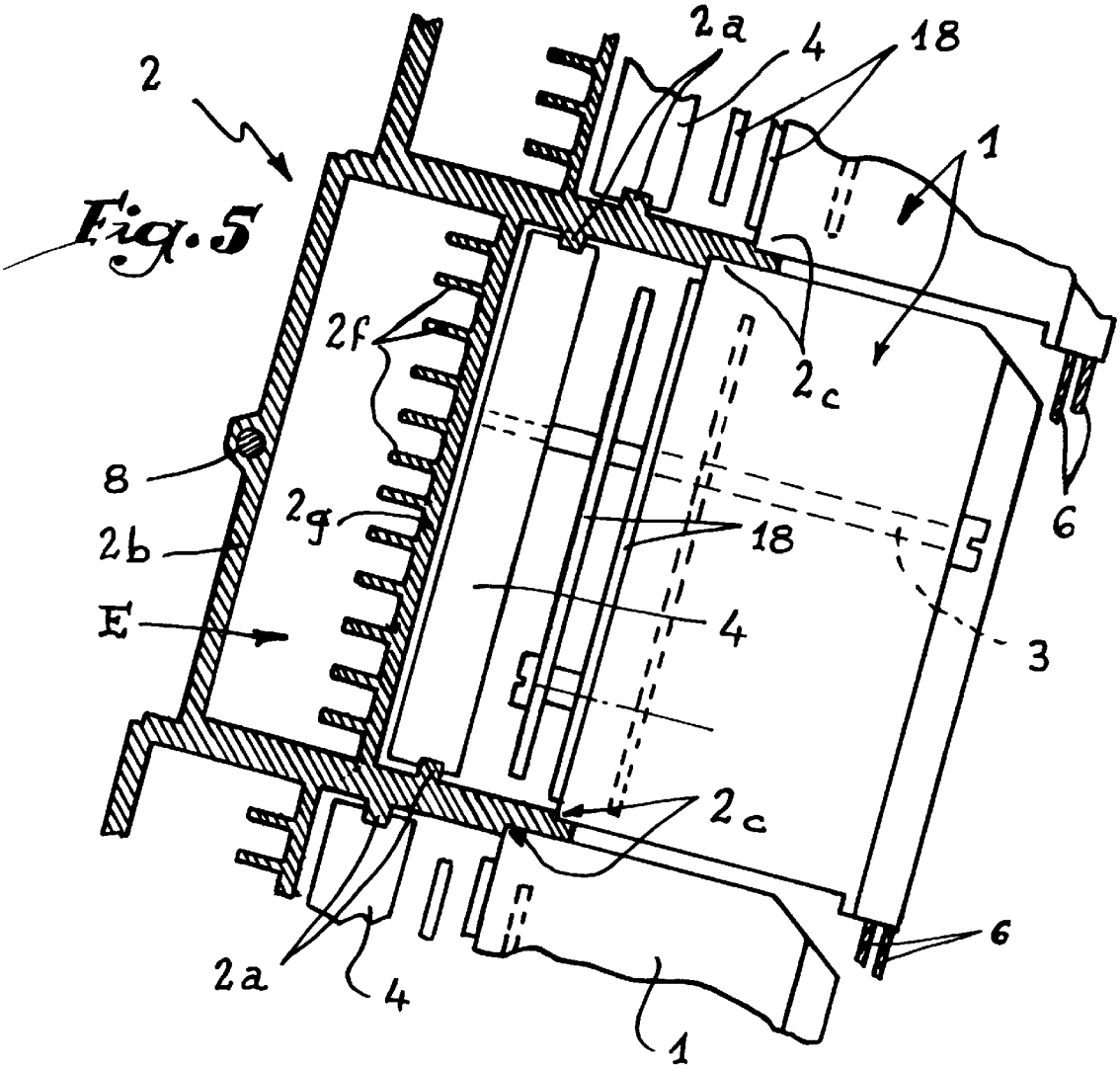
FIG. 5 shows a section analogous to that of FIG. 2, illustrating a third embodiment of the invention.

In the third variant of the embodiment illustrated in FIG. 5, the elements analogous to those of the embodiment of FIGS. 1 and 2 are identified by the same reference numbers. In this embodiment, a rib 2*g* is provided inside of each structural element 2 in order to separate the space E intended for the circulation of an air current for the cooling of the boards 18, which brings about a reduction of the risks of soiling of the boards and of their electronic components, that is caused by the air-borne fluff around weaving looms. On the side facing the space E, the rib 2*g* is provided with cooling fins 2*f*.

In this embodiment, the structural elements 2 are not individually mounted but they are obtained by the same screw-plate, so that the structural element comprises several superimposed rows for the retention of the housings 1, containing the actuators. With this variant of the invention it is possible to constitute the panels A, B and C with a limited number of structural elements, or even with only one. This panel possesses excellent rigidity.

The invention is illustrated with the actuator-carrying housings arranged in rows. It must be understood that these housings can also be arranged in columns, that is to say, that the structural elements 2 can be aligned in a direction parallel to the harness threads 6 in FIG. 1. Thus, it would be possible to mount these columns to each other in such a manner as to also form panels located on the upper part of the loom.

Figure 6:
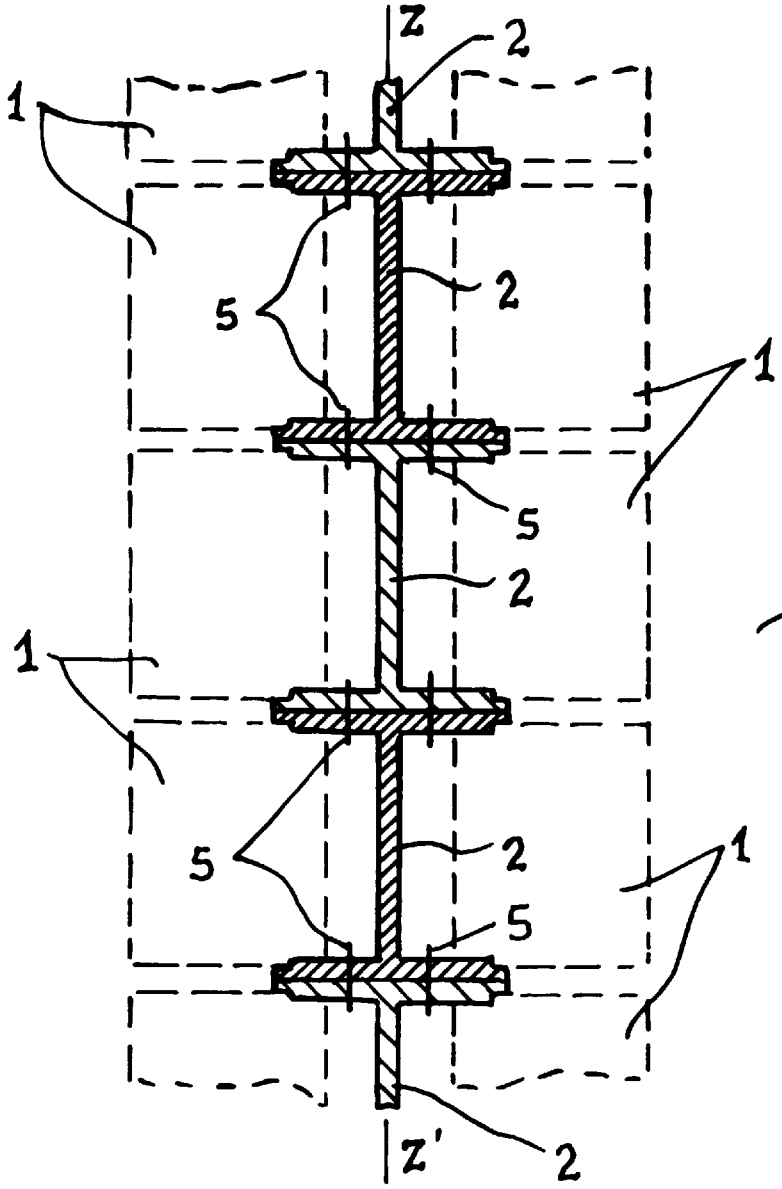
FIG. 6 shows a vertical section of a skeleton diagram of a weaving mechanism according to a fourth variant of the invention.

In the fourth variant of the embodiment illustrated in FIG. 6, the elements analogous to those of the embodiment of FIGS. 1 and 2 are identified by the same reference numbers. In this embodiment, each structural element 2 is provided with an I-shaped section as a support for two housings 1. Thus, an essentially vertical panel can be formed by superimposing the structural elements 2 on each other and assembling them by means of bolts 5.

As in the above embodiment, the structural elements 2 can be obtained by the same screw-plate, with the structural element comprising several superimposed rows for the lodging of the housings on the two sides of the panel to which it belongs.

Figure 7:
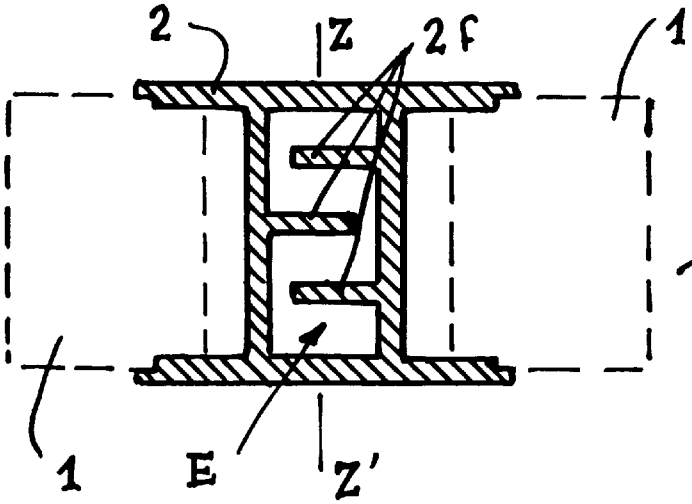
FIG. 7 shows a section of a skeleton diagram of an element of a weaving mechanism according to a fifth variant of the invention.

The structural element 2 illustrated in FIG. 7 is also appropriate to constitute the support for two housings 1 and it differs from the previous one in that its central section is provided with a space E for the circulating of a cooling agent such as air.

In the embodiments of the FIGS. 6 and 7, each structural element 2 is appropriate to serve as support for the housings 1 on both sides of a vertical plan, represented by its line Z–Z'. This makes it suitable to obtain especially compact weaving mechanisms.

Figure 8:
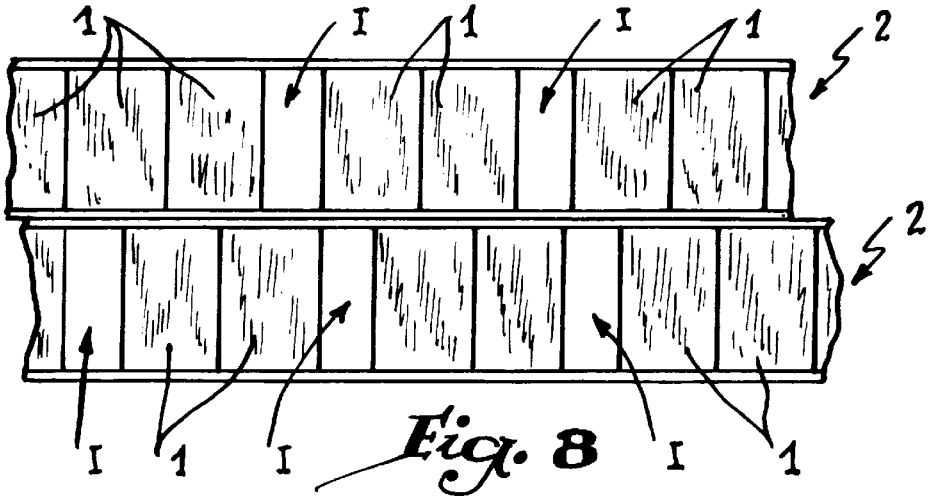
FIG. 8 shows a diagrammatical front view of a panel of housings according to the invention.

As illustrated in FIG. 8, in a configuration in which several housings 1 are arranged on the structural elements 2 forming horizontal rows as a whole, between some housings 1 there can be provided gaps I, which would allow the distribution of the housings 1 along the entire width of the loom; this would optimize the positioning of the harness threads and of the heddles and reduce the stresses to which they are subjected. These gaps I do also allow the spaces E for the circulating of the cooling air current to connect with the atmosphere which facilitates the evacuation of the heat generated by the electronic components.

What we claim is:

1. A Jacquard-type weaving mechanism for the formation of the shed on a weaving loom wherein harness threads are connected to the heddles associated with warp threads and which threads are controlled by electric actuators, the weaving mechanism comprising; at least one control panel including a plurality of housings oriented relative to one another in horizontal rows and/or vertical columns, and each of said housings including a plurality of compartments each of which is adapted to receive an electric actuator therein.

2. A mechanism in accordance with claim 1, wherein each of said rows of housings are horizontally offset from a bottom portion of said at least one panel to an upper portion thereof.

3. A mechanism in accordance with claim 1, wherein said housings of a same row or column are mounted inside of concave structural elements that are mounted to each other to form an assembly.

4. A mechanism in accordance with claim 3, wherein said assembly of the structural elements includes securing means extending in holes in upper and lower flanges of each structural element, and a distance ($d_1$) that separates a bottom wall of each structural element from one of said holes in an upper flange is greater than a distance ($d_2$) separating said bottom wall and one of said holes in a lower flange of each structural element.

5. A mechanism in accordance with claim 3, wherein said housings of at least one row of said at least one panel are provided with guides adapted to have harness threads extending therethrough.

6. A mechanism in accordance with claim 3, wherein a clearance is provided within each of said structural elements adapted to permit circulation of a cooling agent therein.

7. A weaving mechanism in accordance with claim 3, wherein said structural elements include means for supporting said housings on opposite sides of a vertical plane.

8. A mechanism in accordance with claim 6, wherein said clearance is separated from said housings by an internal rib of each structural element.

9. A mechanism in accordance with claim 6 wherein said structural elements include heat exchange members.

10. A mechanism in accordance with claim 1, including a plurality of panels, and at least one of said panels being articulated by a control mechanism.

11. A weaving loom comprising; a weaving mechanism for the formation of the shed and including at least one control panel positioned along a top portion of the loom, said at least one control panel including a plurality of housings oriented relative to one another in horizontal rows and/or vertical columns, and each of said housings including a plurality of compartments each of which is adapted to receive an electric actuator therein for use in controlling movement of a harness thread connected to a heddle.

12. The weaving loom of claim 11 in which each row of said housings is horizontally offset from a vertically disposed row of housings from an upper portion of said at least one panel to said lower portion thereof.

13. The weaving loom of claim 11 including a plurality of said panels, and means for varying an angle of at least one of said panels relative to a vertical plane.

14. The weaving loom of claim 11 in which each of said housings is mounted to a structural element providing a support therefore, each of said structural element including means defining a cooling space therein between a bottom wall of each structural element and a housing supported thereby.

15. The weaving loom of claim 11 including means mounted to at least one of said housings adapted to guide a harness thread relative thereto.

* * * * *